US008082795B2

(12) United States Patent
Trader

(10) Patent No.: US 8,082,795 B2
(45) Date of Patent: Dec. 27, 2011

(54) RAILROAD LOCOMOTIVE HORN TESTING SYSTEM AND METHOD

(76) Inventor: Travis Trader, Jacksonville, FL (US)

( * ) Notice: Subject to any disclaimer, the term of this patent is extended or adjusted under 35 U.S.C. 154(b) by 428 days.

(21) Appl. No.: 12/317,466

(22) Filed: Dec. 23, 2008

(65) Prior Publication Data

US 2010/0154550 A1 Jun. 24, 2010

(51) Int. Cl.
*B61L 29/24* (2006.01)
*B61L 5/20* (2006.01)

(52) U.S. Cl. ..... 73/646; 73/645

(58) Field of Classification Search ..... 73/645, 73/646

See application file for complete search history.

(56) References Cited

U.S. PATENT DOCUMENTS 5,266,921 A * 11/1993 Wilson ..... 340/384.5
5,446,389 A 8/1995 Lenz
6,688,561 B2 2/2004 Mollet et al.
7,242,179 B2 7/2007 Saraswat et al.
2005/0110628 A1 5/2005 Kernwein et al.
2006/0015224 A1 1/2006 Hilleary
2008/0291034 A1 * 11/2008 Kernwein ..... 340/626

OTHER PUBLICATIONS

Rapoza, Amanda and Fleming, Gregg, "The Effect of Installation Location on Railroad Horn Sound Levels", Sep. 2002, U.S. Department of Transportation Federal Railroad Administration, pp. 1-C-19.*

Federal Railroad Administration, CFR 49 Part 229.129—Locomotive Horn, [71 FR 47666, Aug. 17, 2006], pp. 463-464.*

Cutright, Jeff, "Locomotive Horn Testing", Oct. 8, 2008, Tech Tracks, LMOA Members, pp. 1-4.*

* cited by examiner

*Primary Examiner* — Hezron E Williams
*Assistant Examiner* — Rose M Miller
(74) *Attorney, Agent, or Firm* — Thomas C. Saitta

(57) ABSTRACT

A system and method of testing the horn of a railroad locomotive wherein a fixed sensing station and a movable sensing station are provided adjacent a railroad track such that front and rear sensing of the horn decibels occurs simultaneously.

18 Claims, 4 Drawing Sheets

RAILROAD LOCOMOTIVE HORN TESTING SYSTEM AND METHOD

BACKGROUND OF THE INVENTION

This invention relates generally to the field of devices, apparatuses, systems and methods for performing sound measurements of locomotive horns, and in particular relates to such devices, apparatuses, systems and methods that are automated.

Locomotive horns are warning providers to alert persons and vehicle drivers of oncoming railroad trains, and must be sufficiently loud in all directions and in all weather conditions to provide adequate warning as the locomotive approaches grade crossings. Federal regulations from the Federal Railroad Administration require testing of all locomotive horns under prescribed conditions, and all locomotives must be certified by Jun. 24, 2010 as meeting minimum standards in order to comply with 49 CFR Parts 222 and 229. The regulations specify acceptable decibel ranges (96 to 110 dBA), testing equipment parameters, meteorological conditions and the like such that accurate and consistent measurements are obtained.

The methodology in use currently is to perform this horn testing manually utilizing testing personnel. On the positive side, manual testing procedures can be performed with relatively inexpensive equipment that is mobile, such that testing can occur at varying locations. The drawbacks to this manual testing procedure are that it is labor intensive, resulting in high relative personnel costs, the instruments must be set up and moved for each locomotive being tested, the tests can be performed in only one travel direction at a time, most locomotives must be tested in both directions so the number of required horn soundings is doubled, thereby increasing noise pollution, the data must be processed before the results are known, the testing takes a significant amount of time for each locomotive, the testing personnel are exposed to the elements and to multiple high decibel horn soundings, calibrations of the instruments must be performed often, etc.

It is an object of this invention to provide a locomotive horn testing system that addresses the problems of manual testing by providing an automated system and methodology having a dedicated testing location with installed instruments, wherein the testing in both travel directions is performed simultaneously, the testing procedure is rapid, results are immediately reported, on-the-ground operational personnel are not required, and testing costs are reduced.

SUMMARY OF THE INVENTION

In one embodiment the invention is a railroad locomotive horn testing system, said system used to perform a test on the horn of a railroad locomotive positioned on a segment of railroad track to determine if said horn meets mandated requirements, said system comprising in combination a fixed sensing station, said fixed sensing station comprising first means for sensing the audible output of a railroad locomotive horn; a movable sensing station, said movable sensing station comprising second means for sensing the audible output of the railroad locomotive horn simultaneously with said first sensing means; computer means for receiving identifying information pertinent to the particular locomotive being tested, for determining the appropriate testing parameters for said locomotive, for initiating and conducting the testing procedure, and for determining the results of the testing procedure; and instructional means for instructing a locomotive conductor to perform required actions during the testing procedure. The system preferably further comprises, alone or in combination, meteorological testing means for determining weather conditions; data transmission means for transmitting the results of said testing procedure to a remote location; and solar power means for providing electrical power by solar collectors.

The system may further comprise, alone or in combination, a trackway positioned parallel to the railroad track on which the locomotive is positioned, and wherein said movable sensing station is positioned on said trackway; a plurality of lights mounted on said fixed sensing station or a portable video display device to act as said instructional means; and data transmission means for transmitting the results of said testing procedure to a remote location.

The invention is also a method of testing a railroad locomotive horn comprising the steps of providing a fixed sensing station adjacent a segment of railroad track, said fixed sensing station comprising first means for sensing the audible output of a railroad locomotive horn; providing a movable sensing station adjacent said segment of railroad track, said movable sensing station comprising second means for sensing the audible output of a railroad locomotive horn simultaneously with said first sensing means, said movable sensing station being separated from said fixed sensing station by a distance greater than the length of a railroad locomotive; positioning a railroad locomotive on said segment of railroad track between said fixed sensing station and said movable sensing station; moving said movable sensing station to a location determined by the length of said railroad locomotive; and testing the horn of said railroad locomotive. The method preferably further comprises, alone or in combination, the steps of providing computer means for receiving identifying information pertinent to the particular locomotive being tested, for determining the appropriate testing parameters for said locomotive, for initiating and conducting the testing procedure, and for determining the results of the testing procedure; inputting identifying information pertinent to said railroad locomotive and determining the appropriate testing parameters for said railroad locomotive; providing instructional means for instructing on-board testing personnel to perform required actions during the testing procedure; instructing said on-board testing personnel to perform such required actions; providing meteorological testing means for determining weather conditions; determining the weather conditions at the time of the testing procedure; providing data transmission means for transmitting the results of the testing procedure to a remote location; transmitting the results to a remote location; and providing solar power means for providing electrical power by solar collectors; and operating said fixed sensing station and said movable sensing station using electrical power provided by said solar collectors. The method of instructing said on-board testing personnel to perform such required actions may be performed for example using a plurality of lights or a portable display device.

DETAILED DESCRIPTION OF THE INVENTION

With reference to the drawings, the invention will now be described in detail with regard for the best mode and preferred embodiment or embodiments. Disclosed is a system and a method of testing the horn of a railroad locomotive to insure that the horn meets federally mandated standards. The system and method are predominantly automated assemblies and processes, such that the testing procedure can be accomplished with minimal or no personnel in addition to the locomotive on-board testing personnel, such as a conductor, one or more on-site shop personnel, dedicated testing operators or the like. The system and method present a significant improvement over the current methods of manually testing locomotive horns.

Figure 1:
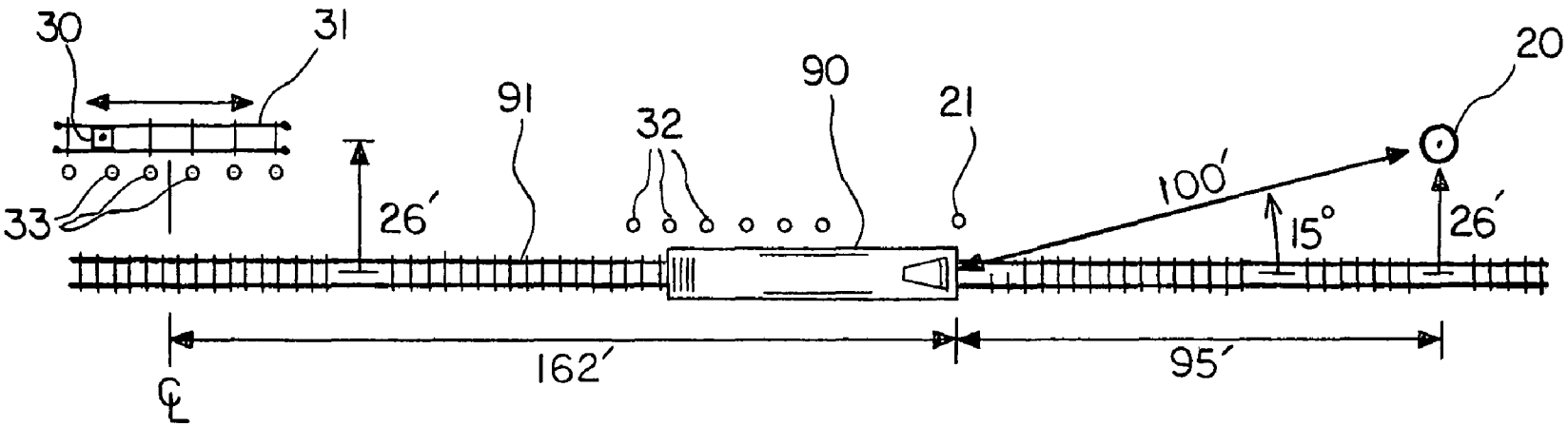
FIG. 1 is a representative overhead view of the system illustrating the location of the sensing stations relative to a locomotive during testing on a straight track segment.
Figure 2:
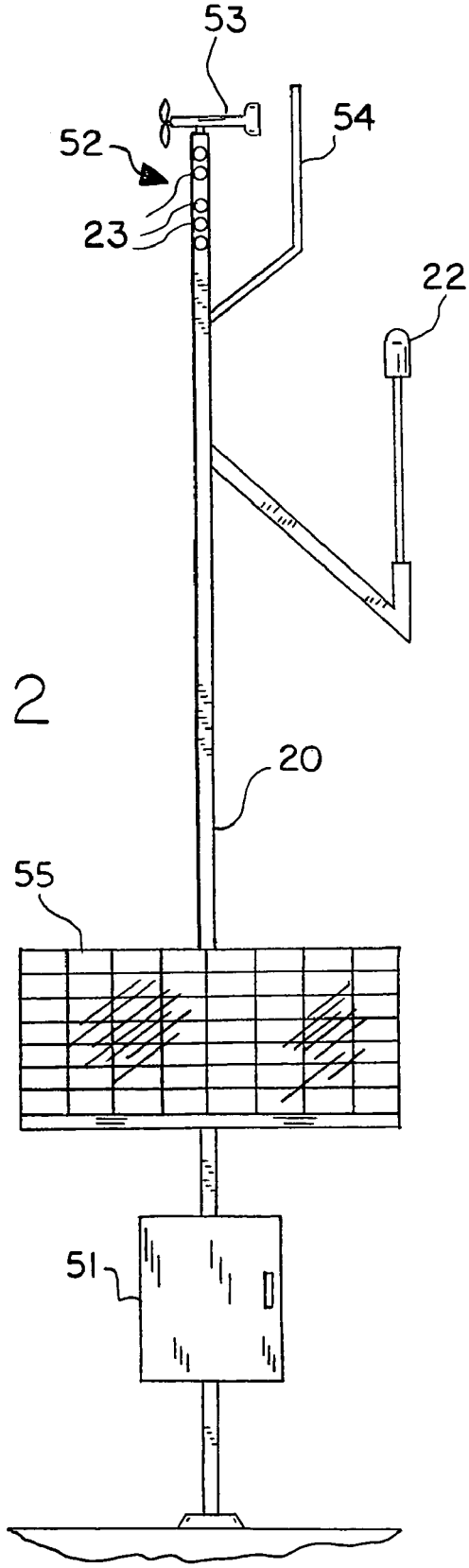
FIG. 2 is a view of a representative fixed sensing station.
Figure 5:
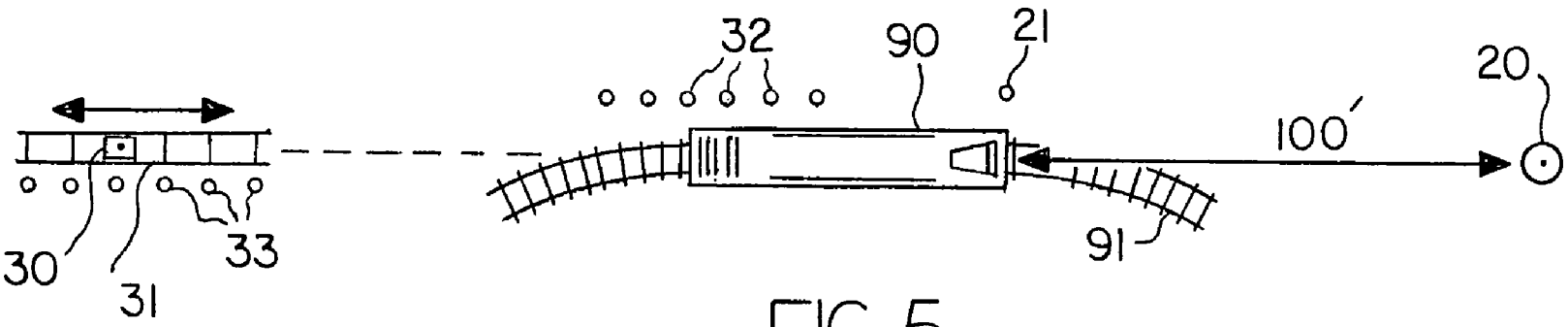
FIG. 5 is a representative overhead view of the system illustrating the location of the sensing stations relative to a locomotive during testing on a curved track segment.

The railroad locomotive horn testing system is a combination of elements and members to be used in conjunction with railroad locomotive 90 positioned on a segment of straight railroad track 91 at a desired testing location, as shown in FIG. 1, or on a curved segment of track, as shown in FIG. 5. In a broad sense, the system comprises in combination a fixed sensing station 20 and a movable sensing station 30 that are positioned adjacent the railroad track 91 whereby the locomotive undergoing the testing procedure will be located between the fixed sensing station 20 and the movable sensing station 30. The stations 20 and 30 may structurally comprise housings, towers, frameworks or the like. A forward end stop marker 21 or similar means is provided adjacent the track 91 as a visual indicator for the proper position of the front knuckle of the locomotive 90 during testing. Preferably, the fixed sensing station 20 is located 100 feet from designated position of the front knuckle at an angle of up to 20 degrees and more preferably 15 degrees from the centerline of the railroad track 91, which results in the fixed sensing station 20 being located approximately 95 feet down the track 91 and at a right angle to the track 91 of approximately 26 feet. The fixed sensing station 20 is constructed, mounted or otherwise connected to support structure such that the position of the fixed sensing station 20 does not change.

Figure 3:
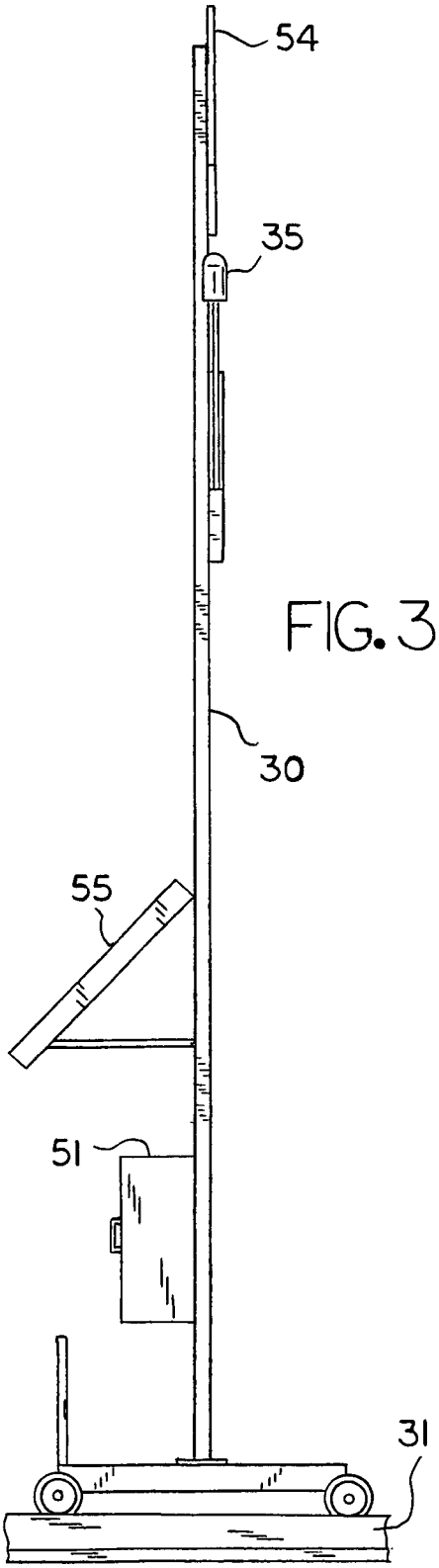
FIG. 3 is a side view of a representative movable sensing station and trackway.
Figure 4:
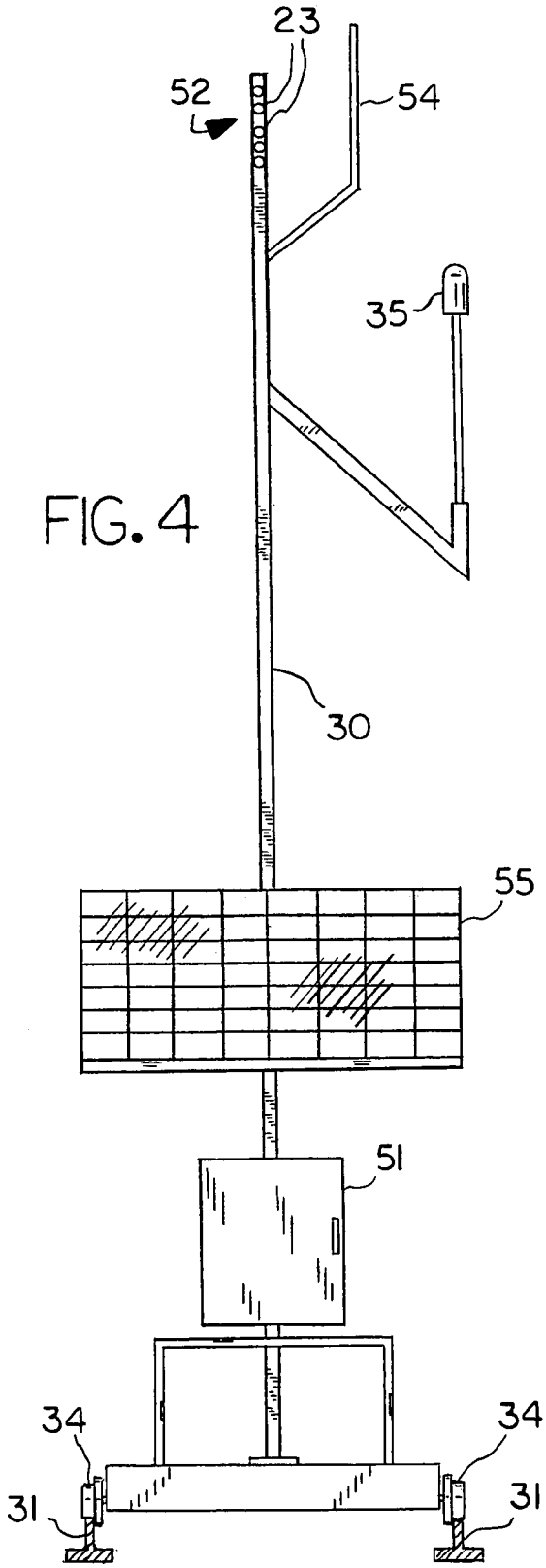
FIG. 4 is a front view of the representative movable sensing station and trackway of FIG. 3.

The movable sensing station 30 is likewise positioned approximately 26 feet from the centerline of the railroad track 91. A straight trackway 31 is positioned adjacent and parallel to the railroad track 91, and the movable sensing station 30 is mounted on or operationally connected to the trackway 31 such that the location of the movable sensing station 30 can be changed by moving the movable sensing station along the trackway closer to or farther from the fixed sensing station 20. In this manner the proper separation distance of 100 feet between the rear knuckle of the locomotive 90 and the movable sensing station 30 is easily attained. The trackway 31 may comprise any means to allow linear reciprocation of the movable sensing station 30, such as a dual rail track (as shown in the drawings), a single rail, channel, shaft, etc. Preferably, a plurality of fixed distance markers 32 are positioned adjacent or on the railroad track 91 spanning the possible location for the rear knuckle of the locomotive 90 to account for the variation in locomotive 90 length, which may range from about 44 to 80 feet. A plurality of fixed trackway markers 33 are positioned adjacent or on the trackway 31, the individual trackway markers 33 corresponding by color or written indicia to the individual distance markers 32 such that the proper location of the movable sensing station 30 on the trackway 31 is readily ascertained. Preferably, the trackway 31 is about 44 feet in length and the midpoint of the trackway 31 is 162 feet from the forward end stop marker 21. Means for allowing movement of the movable sensing station 30 on trackway 31 are provided, such as for example flanged wheels 34 as shown in FIGS. 3 and 4.

For a curved segment of railroad track 91, as shown in FIG. 5, the sensing stations 20 and 30 are preferably located on the tangent line defined by the locomotive 90 relative to the curved track 91, which allows the sensing stations 20 and 30 to be located directly to the front and rear of the locomotive 90. The trackway 31 for the movable sensing station 30 is now positioned parallel to the locomotive 90 or the defined tangent.

The fixed sensing station 20 comprises a first means for sensing the audible output of a railroad locomotive horn, such as a microphone 22, and the movable sensing station 30 comprises a second means for sensing the audible output of the railroad locomotive horn simultaneously with said first sensing means, such as a microphone 35. Preferably, the microphones 22 and 35 are positioned approximately 15 feet above the level of the railroad track 91, and multiple or redundant microphones 22 and 35 may be utilized.

The railroad locomotive horn testing system further comprises computer means 51 for receiving identifying information pertinent to the particular locomotive 90 being tested, for determining the appropriate testing parameters for said locomotive 90, for initiating and conducting the testing procedure, and for determining the results of the testing procedure; and instructional means 52 for instructing on-board testing personnel, which may be a single individual, to perform required actions during the testing procedure, i.e., instructing the on-board testing personnel when and for how long to blow the horn, suitable operational programming being provided to operate the computer means 51 and instructional means 52, and such means being well known in the art. In a basic embodiment, the instructional means may comprise a plurality of indicator lights 23 of different colors located on the fixed sensing station 20 and the movable sensing station 30 which are visible to the on-board testing personnel during the test procedure. Alternatively, the instructional means may comprise a portable visual display device, such as a handheld computer in communication with the computer means.

The system preferably further comprises, alone or in combination, meteorological testing means 53 for determining weather conditions, preferably mounted to one of the sensing stations 20 and 30, data transmission means 54 for transmitting the results of said testing procedure to a remote location, such as via radio, cell phone or other wireless technology, and solar power means 55 for providing electrical power by solar collectors, such means being known in the art. Preferably, data transmission means 54 and the solar power means 55 are mounted to both sensing stations 20 and 30.

The invention is also a method of testing a railroad locomotive horn comprising the steps of providing a fixed sensing station 20 adjacent a segment of railroad track 91, the fixed sensing station 20 comprising first means for sensing the audible output of a railroad locomotive horn, such as a microphone 22; providing a movable sensing station 30 adjacent the segment of railroad track 91, the movable sensing station 30 comprising second means for sensing the audible output of a railroad locomotive horn simultaneously with the first sensing means, such as a microphone 35, the movable sensing station 30 being separated from the fixed sensing station 20 by a distance greater than the length of a railroad locomotive 90; positioning a railroad locomotive 90 on the segment of railroad track 91 between the fixed sensing station 20 and the movable sensing station 30, the railroad locomotive 90 being operated by a conductor; moving the movable sensing station 30 to a location determined by the length of the railroad locomotive 90; and testing the horn of the railroad locomotive 90. The method preferably further comprises, alone or in combination, the steps of providing computer means 51 for receiving identifying information pertinent to the particular locomotive 90 being tested, for determining the appropriate testing parameters for the locomotive 90, for initiating and conducting the testing procedure, and for determining the results of the testing procedure; inputting identifying information pertinent to the railroad locomotive 90 and determining the appropriate testing parameters for the railroad locomotive 90; providing instructional means 52 for instructing the on-board testing personnel to perform required actions during the testing procedure; instructing the on-board testing personnel to perform such required actions; providing meteorological testing means 53 for determining weather conditions; determining the weather conditions at the time of the testing procedure; providing data transmission means 54 for transmitting the results of the testing procedure to a remote location; transmitting the results to a remote location; and providing solar power means 55 for providing electrical power by solar collectors; and operating the fixed sensing station 20 and the movable sensing station 30 using electrical power provided by the solar collectors. The method of instructing the on-board testing personnel to perform such required actions may be performed for example using a plurality of indicator lights 23 or a portable display device.

In practice, a railroad locomotive 90 is driven onto the track 91 and the on-board testing personnel stops the locomotive 90 such that the front knuckle is even with the forward end stop marker 21. The on-board testing personnel then notes the length of the locomotive 90 using the distance markers 32 and moves the movable sensing station 30 to the proper location using the trackway markers 33. Information on the particular locomotive 90, such as the model, year, horn position, horn type, etc., is input in to the computer means such that the software programming can determine and implement the correct testing procedure. The sensing stations 20 and 30 are activated and various pre-test data is sensed, such as the ambient noise level and meteorological conditions including wind speed, temperature and relative humidity. If noise or weather conditions are not within the acceptable ranges, the test will not be allowed to continue. The on-board testing personnel is then instructed by the instructional means 52 to sound the horn for a predetermined period, typically 10 seconds after decibel stabilization is reached. This cycle is then repeated multiple times. The computer means 51 then calculates the decibel level and standard deviation to determine if the horn is sounding within the acceptable range in both the forward and rear directions. The data may be sent by data transmission means 54 to a remote location for confirmation or record keeping purposes, and a formal certification form may be produced.

It is contemplated that equivalents or substitutions for elements or steps set forth above may be obvious to those of ordinary skill in the art, and therefore the true scope and definition of the invention is to be as set forth in the following claims.

I claim:

1. A railroad locomotive horn testing system, said system used to perform a test on the horn of a railroad locomotive positioned on a segment of railroad track to determine if said horn meets mandated requirements, said system comprising in combination:

a fixed sensing station, said fixed sensing station comprising first means for sensing the audible output of a railroad locomotive horn;

a movable sensing station, said movable sensing station comprising second means for sensing the audible output of the railroad locomotive horn simultaneously with said first sensing means;

a trackway positioned adjacent to the railroad track on which the locomotive is positioned, wherein said movable sensing station is positioned on said trackway;

computer means for receiving identifying information pertinent to the particular locomotive being tested, for determining the appropriate testing parameters for said locomotive, for initiating and conducting the testing procedure, and for determining the results of the testing procedure;

and instructional means for instructing on-board testing personnel to perform required actions during the testing procedure.

2. The system of claim 1, further comprising meteorological testing means for determining weather conditions.

3. The system of claim 1, further comprising data transmission means for transmitting the results of said testing procedure to a remote location.

4. The system of claim 1, further comprising solar power means for providing electrical power by solar collectors.

5. The system of claim 1, wherein said instructional means comprises a plurality of lights mounted on said fixed sensing station.

6. The system of claim 1, wherein said instructional means comprises a portable video display device.

7. The system of claim 2, further comprising data transmission means for transmitting the results of said testing procedure to a remote location.

8. The system of claim 7, further comprising solar power means for providing electrical power by solar collectors.

9. A method of testing a railroad locomotive horn comprising the steps of:

providing a fixed sensing station adjacent a segment of railroad track, said fixed sensing station comprising first means for sensing the audible output of a railroad locomotive horn;

providing a trackway adjacent to said segment of railroad track;

providing a movable sensing station and positioning said movable sensing station on said trackway, said movable sensing station comprising second means for sensing the audible output of a railroad locomotive horn simultaneously with said first sensing means, said movable sensing station being separated from said fixed sensing station by a distance greater than the length of a railroad locomotive;

positioning a railroad locomotive on said segment of railroad track between said fixed sensing station and said movable sensing station, said railroad locomotive being operated by on-board testing personnel;

moving said movable sensing station on said trackway to a location determined by the length of said railroad locomotive; and testing the horn of said railroad locomotive.

10. The method of claim 9, further comprising the steps of:

providing computer means for receiving identifying information pertinent to the particular locomotive being tested, for determining the appropriate testing parameters for said locomotive, for initiating and conducting the testing procedure, and for determining the results of the testing procedure;

inputting identifying information pertinent to said railroad locomotive and determining the appropriate testing parameters for said railroad locomotive;

providing instructional means for instructing said on-board testing personnel to perform required actions during the testing procedure; and instructing said on-board testing personnel to perform such required actions.

11. The method of claim 9, further comprising the steps of:

providing meteorological testing means for determining weather conditions; and determining the weather conditions at the time of the testing procedure.

12. The method of claim 9, further comprising the steps of:

providing data transmission means for transmitting the results of the testing procedure to a remote location; and transmitting the results to a remote location.

13. The method of claim 9, further comprising the steps of:

providing solar power means for providing electrical power by solar collectors; and operating said fixed sensing station and said movable sensing station using electrical power provided by said solar collectors.

14. The method of claim 10, wherein said step of instructing said on-board testing personnel to perform such required actions is performed using a plurality of lights.

15. The method of claim 10, wherein said step of instructing said on-board testing personnel to perform such required actions is performed using a portable video display device.

16. The method of claim 10, further comprising the steps of:

providing meteorological testing means for determining weather conditions; and determining the weather conditions at the time of the testing procedure.

17. The method of claim 16, further comprising the steps of:

providing data transmission means for transmitting the results of the testing procedure to a remote location; and transmitting the results to a remote location.

18. The method of claim 17, further comprising the steps of:

providing solar power means for providing electrical power by solar collectors; and operating said fixed sensing station and said movable sensing station using electrical power provided by said solar collectors.

* * * * *